US005351612A

United States Patent [19]

Kemper et al.

[11] Patent Number: 5,351,612

[45] Date of Patent: Oct. 4, 1994

[54] WATER COOLED SLEEVE

[75] Inventors: Timothy G. Kemper, Piqua; James King, Jr, Sidney, both of Ohio; Hugo J. Espinal, Chinandega, Nicaragua

[73] Assignee: The French Oil Mill Machinery Co., Piqua, Ohio

[21] Appl. No.: 82,097

[22] Filed: Jun. 24, 1993 (Under 37 CFR 1.47)

[51] Int. Cl.[5] ..... B30B 15/34; B30B 9/14

[52] U.S. Cl. ..... 100/93 S; 100/129

[58] Field of Search ..... 100/93 S, 117, 129, 100/145

[56] References Cited

U.S. PATENT DOCUMENTS

| | | | |
|---|---|---|---|
| 2,149,736 | 3/1939 | Hiller et al. | 100/93 S X |
| 2,262,566 | 11/1941 | Upton | 100/93 S |
| 2,320,765 | 6/1943 | Upton | 100/93 S |
| 2,369,192 | 2/1945 | Upton | 100/93 S |
| 3,005,401 | 10/1961 | French . | |
| 3,067,672 | 12/1962 | French . | |
| 3,093,065 | 6/1963 | French . | |
| 3,108,530 | 10/1963 | Zies . | |
| 3,111,080 | 11/1963 | French et al. . | |
| 3,130,666 | 4/1964 | Hiller | 100/93 S |
| 3,181,454 | 5/1965 | Ginaven et al. | 100/93 S X |
| 3,246,597 | 4/1966 | Burner . | |
| 3,276,354 | 10/1966 | Burner | 100/129 X |
| 3,548,743 | 12/1970 | Pickel . | |
| 4,361,081 | 11/1982 | Howard . | |

FOREIGN PATENT DOCUMENTS

| | | | |
|---|---|---|---|
| 670193 | 4/1952 | United Kingdom | 100/129 |

*Primary Examiner*—Stephen F. Gerrity
*Attorney, Agent, or Firm*—Biebel & French

[57] ABSTRACT

A sleeve is provided for a mechanical screw press for expressing liquid from liquid-containing grains and seeds. The sleeve of the present invention is formed with drainage apertures located between longitudinally extending runner portions and includes slots formed in the runner portions adjacent to the drainage apertures. With the use of such slots, uniform screen bars can be used throughout the sleeve and main cage of the screw press.

6 Claims, 5 Drawing Sheets

WATER COOLED SLEEVE

BACKGROUND OF THE INVENTION

This invention relates to a sleeve for use in a mechanical screw press and, more particularly, to an improved sleeve construction for a high-pressure mechanical screw press for continually expressing liquid from liquid contained seeds or grains.

Generally, screw presses are of heavy construction which allows the seed or grain material to be pressed under extremely high pressures and temperatures to express the oils or liquids.

Screw presses generally comprise a main cage having side walls with linear apertures to drain the liquids or oils pressed from the grains or seeds. The side walls of the main cage include linear screen bars supported by semi-cylindrical sleeves wherein pairs of sleeves are fastened together in facing relationship along the length of the main cage to form, in combination with the screen bars, a cylindrical passage. In addition, each sleeve is formed with drainage apertures such that liquid passing through the linear apertures between the screen bars will drain out of the main cage through the sleeve.

Each of the pressure worms includes a screw flight mounted for rotation on a shaft, and pressure collars having a radially outwardly angled circumferential surface are provided between adjacent pressure worms to form restrictions to the passage of material through the main cage of the screw press. Therefore, when the shaft is rotated, thereby rotating the pressure worms, the material within the press is forced into the passage between the pressure collars and the linear screen bars such that the material is compressed in the passage to express out fluids contained in the material. The fluids then pass through the linear apertures defined between the screen bars and through the drainage apertures of the sleeves for collection thereof.

Each of the semi-cylindrical sleeve portions include a plurality of curved circumferentially extending slat portions formed integrally with longitudinally extending runner portions wherein the drainage apertures are defined between the slat portions and the lateral edges of the apertures are defined by the runner portions. Typically each of the slat and runner portions include fluid passages for conveying a cooling fluid through the sleeve to control the temperature of the main cage during an expressing operation.

In order to allow the liquids or oils to drain from the runner portions of the semi-cylindrical sleeve, laterally outwardly from the drainage apertures, the screen bars lying along the runner portions are each provided with laterally extending notches on a face thereof that lies in contact with the sleeve. Thus, fluids passing between the screen bars located on the runner portions will flow through the notches and then pass through the drainage apertures.

The use of the notched out screen bars along the runner portions of the semi-cylindrical sleeves has been found to be inconvenient in that two different types of screen bars are required in the main cage, one being with notches and the other being without notches. In addition, the notches must be aligned with the drainage apertures during installation of the screen bars which increases the amount of time required to install the bars.

Thus, there is a need to provide a means in which a single type of screen bar can be used throughout the main cage and yet allow the liquids or oils expressed from the seeds or grains to pass to the drainage apertures from the screen bars located on the runner portions. Further, there is a need to provide a structure incorporating a screen bar which is uniformly easy to install on the sleeve.

SUMMARY OF THE INVENTION

The present invention provides a sleeve which is used in a mechanical screw press of a type in which grains or seeds are compressed along a passage defined by screen bars supported by a cylindrical sleeve structure. The screen bars define elongated apertures along the length of the press for permitting the liquids or oils expressed from the grains or seeds to pass out of the passage.

The cylindrical sleeve structure includes semicylindrical sleeve portions joined together to provide a cylindrical inner wall for supporting the screen bars. Each sleeve portion includes curved circumferentially extending slat portions formed integrally with longitudinally extending runner portions to define a plurality of drainage apertures with longitudinally extending lateral edges. The slat and runner portions include means defining fluid passages for conveying a cooling liquid through the sleeve.

Each runner portion defines a side edge of the sleeve and slots are defined in each runner portion between the lateral edges of each of the drainage apertures and respective side edges of the runner portions. The slots form fluid flow paths behind the screen bars such that the liquid or oils expressed from the grains or seeds will pass through the elongated apertures between the screen bars and flow to the drainage apertures via the slots.

Therefore, a uniform screen bar can be used throughout the cylindrical inner wall of the sleeve structure which screen bar is adapted to be easily installed without special attention to alignment of the bar relative to the drainage apertures.

Thus, it is an object of the present invention to provide a sleeve which allows the liquids or oils expressed from the seeds or grains to pass from the runner portions of each sleeve to drainage apertures.

Another object of the present invention is to provide a sleeve which allows a single uniform screen bar to be used throughout the entire cylindrical inner wall of the main cage.

A further object of the present invention is to provide a water cooled sleeve which has slots along the runner portions to allow the liquids and oils expressed from the grains and seeds to pass therethrough to drainage apertures located between longitudinally extending runner portions.

DETAILED DESCRIPTION OF THE PREFERRED EMBODIMENT

Figure 1:
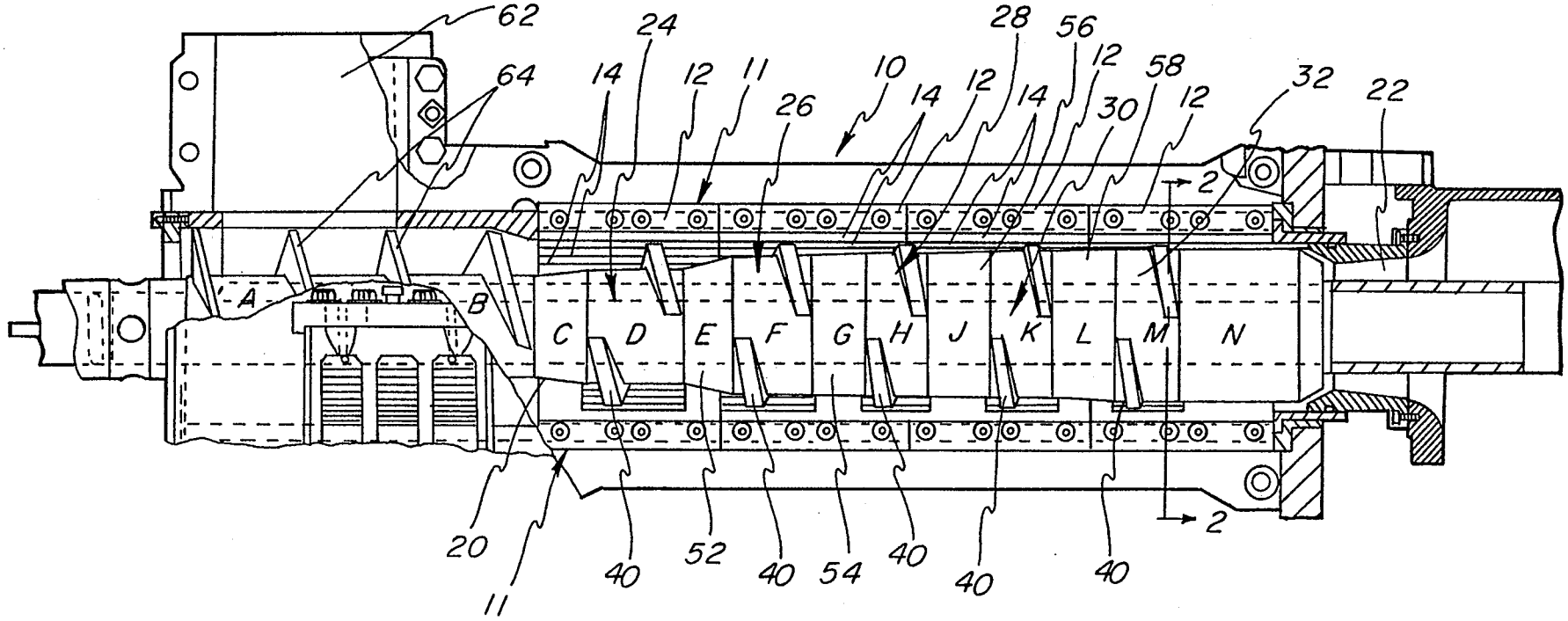
FIG. 1 is an elevational view of a screw press with the main cage portion partially cut away.
Figure 2:
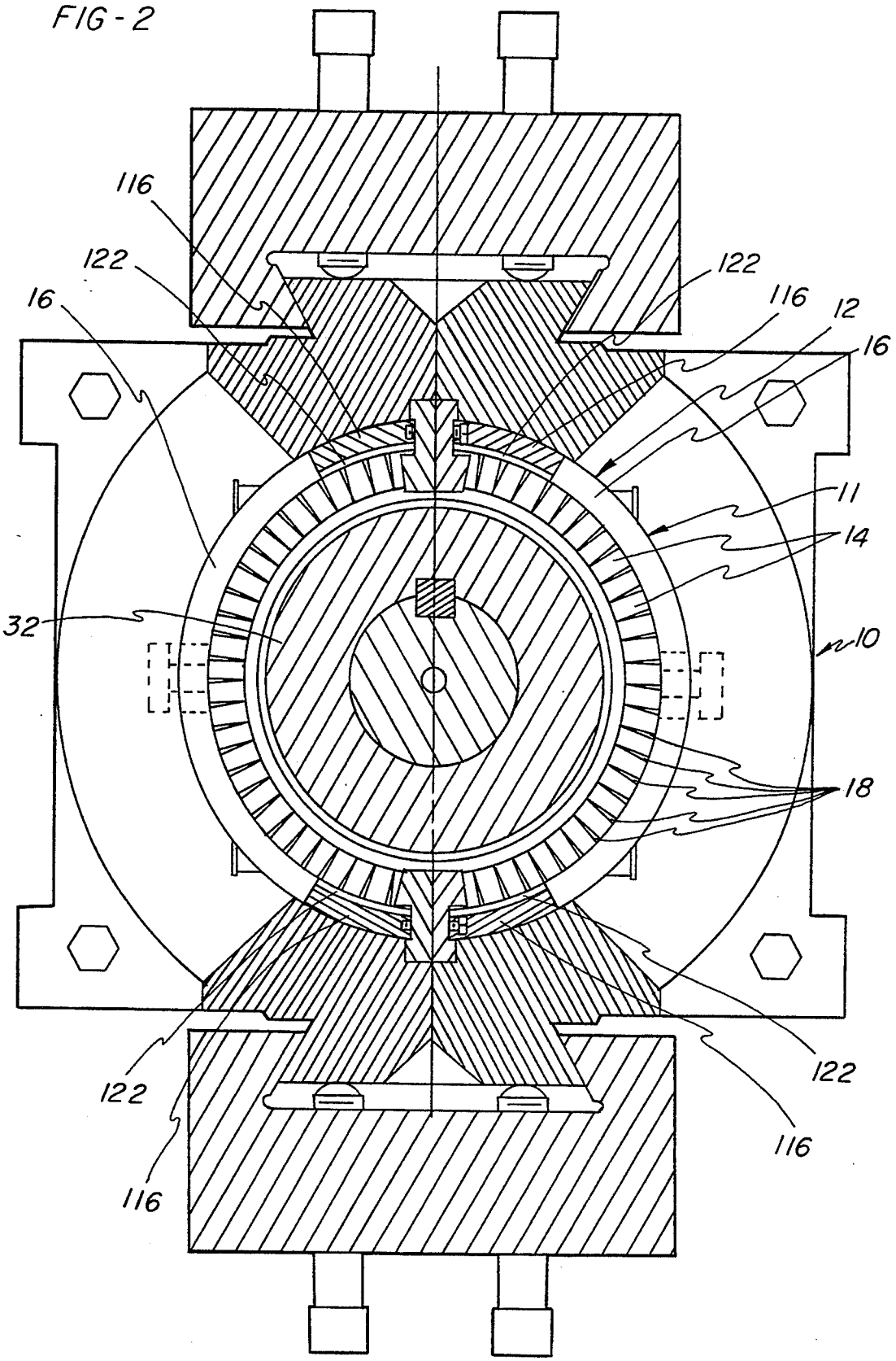
FIG. 2 is an elevational cross-sectional view taken along line 2—2 in FIG. 1.

Referring to FIGS. 1 and 2, the screw press in which the sleeves of the present invention are used includes a main cage 10 including a cylindrical side wall 11. The side wall 11 is defined by a plurality of sleeves 12 supporting a plurality of screen bars 14 which extend longitudinally in the screw press. The screen bars 14 form linear apertures 18 (see FIG. 2) for draining the liquid or oil expressed from seeds or grains processed through the press. Details of the main cage construction are well-known in the art, such as may be seen in U.S. Pat. No. 3,093,065 issued to French, which is incorporated herein by reference.

As shown in FIG. 1, the screen bars 14 form a passage through the press from an inlet end 20 to an outlet end 22. A plurality of worm sections for pressing and conveying the grains and seeds through the screw press include press worm sections 24, 26, 28, 30 and 32. The worm sections 24, 26, 28, 30 and 32 are separated from each other by pressure collars 52, 54, 56 and 50. Screw flights 40 are provided for each of the worm sections to convey the material through the passage.

In operation, seeds and grains are fed into hopper 62 and conveyed to the inlet end 20 of the screw press by screw flight 64. The seeds and grains are then forced through the press by the worm sections which are rotated in a counterclockwise direction, as viewed from inlet end 20. The screw flights 40 will force the grains or seeds through the passage into engagement with the pressure collars 52, 54, 56 and 58 such that the material is forced between the collars 52, 54, 56, 58 and the screen bars 14 causing liquids or oils to be expressed from the seeds or grains. As the liquid is expressed from the material, it will drain through linear apertures 18 between the screen bars 14 (FIG. 2). Once the liquid has passed through the linear apertures 18, the liquid will drain through drainage apertures 16 in the sleeves 12.

The seeds or grains are expressed and conveyed through the screw press and finally exit out outlet port 22 as a cake-like or pellet-like discharge.

Figure 3:
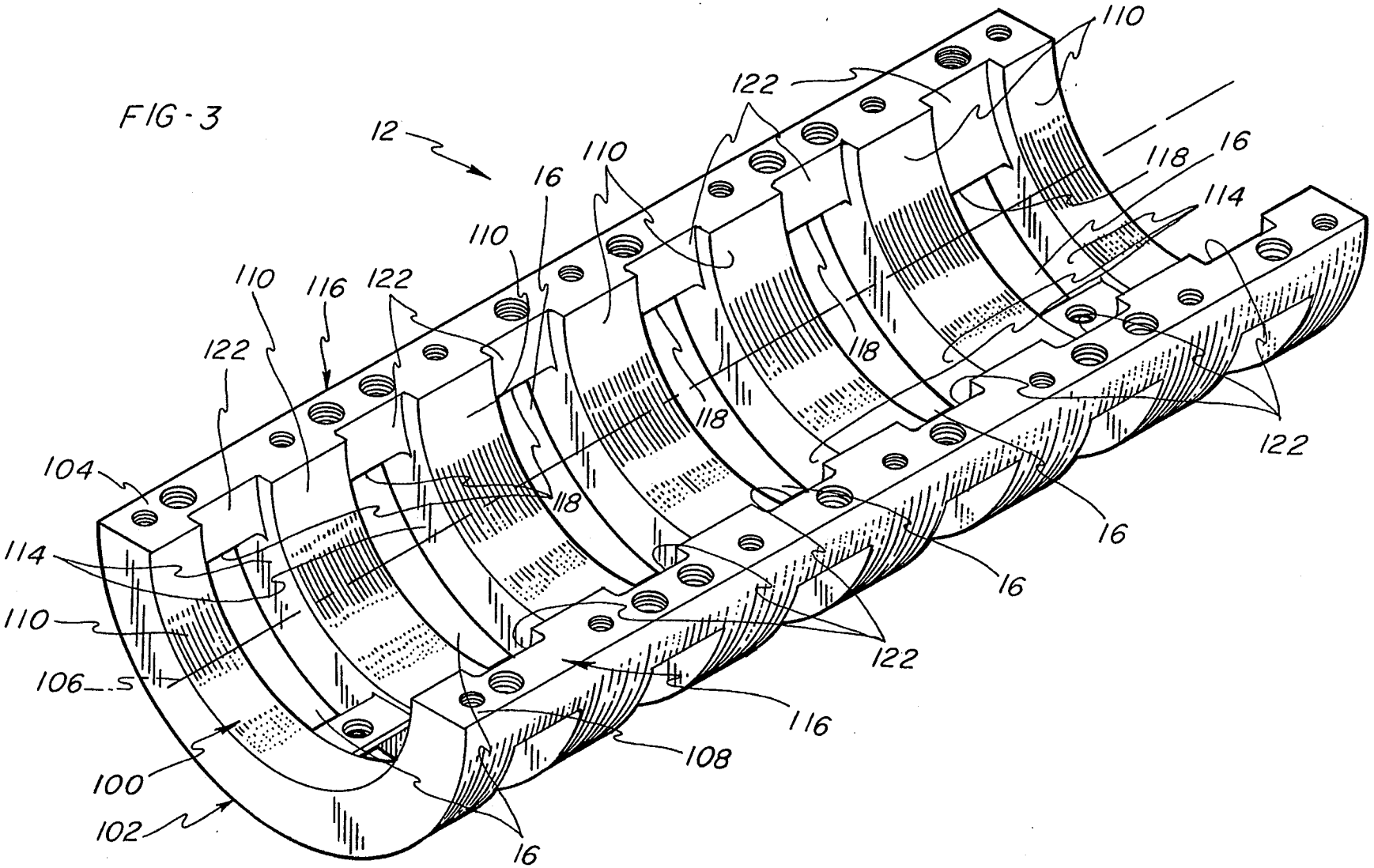
FIG. 3 is a perspective view of the sleeve of the present invention.
Figure 4:
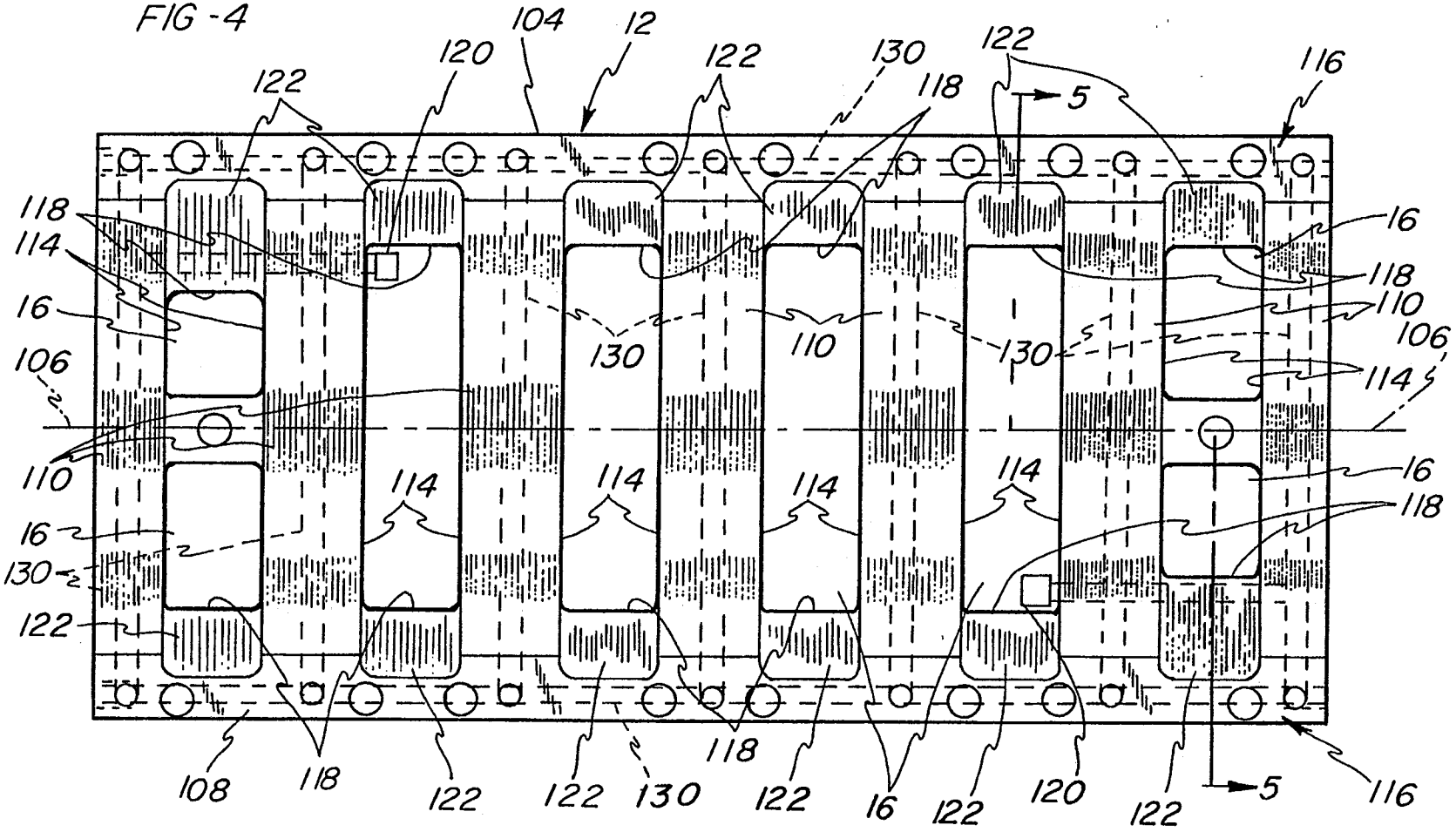
FIG. 4 is a plan view of the inside surface of the sleeve of the present invention.
Figure 5:
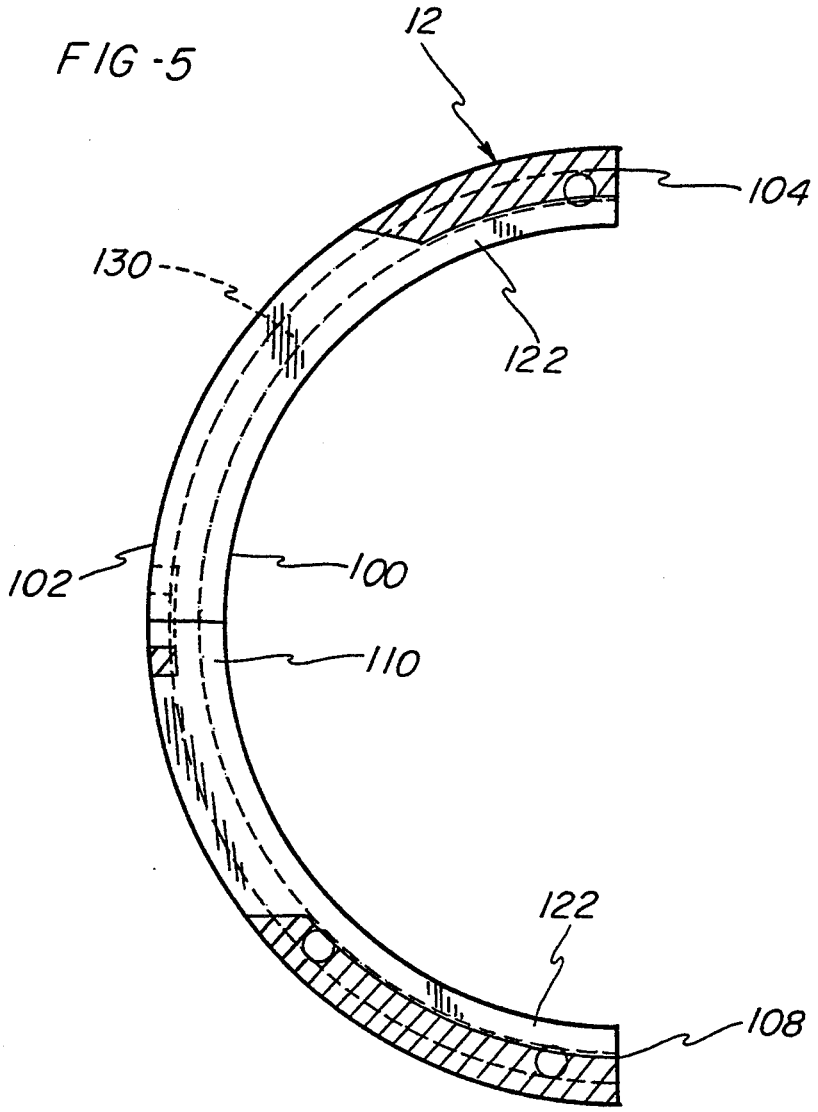
FIG. 5 is a cross-sectional view of the sleeve taken along line 5—5 in FIG. 4.

Referring to FIGS. 3, 4, and 5, sleeve 12 of the present invention is shown with a curved inner wall 100 defining a first radius of curvature. The sleeve 12 also has a curved outer wall 102 which defines a second radius of curvature greater than the first radius of curvature. First and second side edges 104, 108 extend parallel to a longitudinal axis 106 of the sleeve 12. The first and second side edges 104, 108 connect the curved inner wall 100 to the curved outer wall 102.

The inner and outer walls 100, 102 are partially defined by curved circumferential slat portions 110 located intermediate to the first and second side edges 104, 100 of the sleeve 12. A pair of runner portions 116 formed integrally with the slats 110 extend longitudinally parallel to the axis 106 and define the side edges 104 and 108. Each slat portion 110 includes elongated edges 114 and the runner portions 116 define lateral edges 118 extending between adjacent elongated edges 114 whereby a plurality of drainage apertures 16 are defined by the slat and runner portions 110, 116.

Slots 122 are defined in the runner portions 116 between the side edges 104, 108 and the drainage apertures 16. The slots 122 extend radially inwardly into the runner portions 116 from the inner wall 100 toward the outer wall 102 such that fluid passing through the linear apertures 18 defined by the screen bars 14 adjacent to the side edges 104, 100 will flow through the slots 122 and then through the drainage apertures 116. It should be noted that each slot 122 defines a dimension in a longitudinal direction which is preferably substantially equal to the length of a lateral edge 110 of a drainage aperture 16 immediately adjacent to the slot 122. Thus, it should be apparent that with the sleeve 12 of the present invention, it is no longer necessary to provide specially notched screen bars to ensure proper flow of expressed fluids from the lateral edges of the sleeve to the drainage apertures 16.

Referring to FIG. 4, it should be additionally noted that a plurality of fluid passages 130 are formed in the slat and runner portions 110, 116 for conveying a cooling fluid, such as water, in both a longitudinal and a lateral direction through the sleeve 12 in order to control the temperature of the sleeve 12 during operation of the press.

The sleeve further includes inlet and outlet connectors 120 in fluid communication with the fluid passage 130 whereby water may be supplied to the fluid passage 130 to maintain the temperature within the press at a desired level in order to maximize the expressing process.

In accordance with the present invention the connectors 120 are positioned such that the water entering and exiting the connectors 120 circulates from one corner of the sleeve 12 through the cooling passages 130 to the diagonal distal corner of the sleeve 12, thereby maintaining the sleeve 12 at a desired temperature during operation of the screw press.

It should be understood that each sleeve 12 is a subassembly which includes a plurality of screen bars 14. This allows each sleeve subassembly to be interchangeable. The interchangeability of the sleeves provides quick and easy maintenance of the screw press.

While the form of apparatus herein described constitutes a preferred embodiment of this invention, it is to be understood that the invention is not limited to this precise form of apparatus, and that changes may be made therein without departing from the scope of the invention which is defined in the appended claims.

What is claimed is:

1. A sleeve for use in a mechanical screw press for compressing loose solid particles along a passage defined by screen bars supported by said sleeve to form an interior wall for said press, said screen bars defining elongated apertures along the length of said press for permitting fluids expressed from said loose solid particles to pass out of said passage, said sleeve comprising:

a curved inner wall defining a first radius of curvature;

a curved outer wall defining a second radius of curvature;

first and second side edges extending parallel to a longitudinal axis of said sleeve and connecting said inner and outer walls;

a plurality of drainage apertures formed through said walls and located between said first and second side edges for permitting drainage of fluids passing through said elongated apertures defined by said screen bars, said drainage apertures including lateral edges extending substantially parallel to said longitudinal axis; and slots between said side edges and said drainage apertures, said slots extending radially inwardly from said inner wall toward said outer wall such that fluid passing through said elongated apertures defined by said screen bars located adjacent to said side edges will flow into said slots and then through said drainage apertures.

2. The sleeve of claim 1, wherein said drainage apertures include a plurality of curved slats spaced longitudinally from each other and connected at lateral ends thereof by longitudinally extending runner portions, said slots being formed in said runner portions.

3. The sleeve of claim 2, including fluid passages in said slats and said runner portions for conveying a cooling fluid in both a longitudinal and a lateral direction through said sleeve.

4. The sleeve of claim 1, wherein each said slot defines a dimension in a longitudinal direction substantially equal to the length of said lateral edges of a drainage aperture immediately adjacent to said slot.

5. The sleeve of claim 1, wherein said sleeve semi-cylindrical.

6. In a mechanical screw press for compressing loose solid particles along a passage defined by screen bars supported by a cylindrical sleeve, said screen bars defining elongated apertures along the length of said press for permitting fluids expressed from said loose solid particles to pass out of said passage, said cylindrical sleeve including semi-cylindrical sleeve portions joined together to define a cylindrical inner wall for supporting said screen bars, each said sleeve portion including curved circumferentially extending slats connected by longitudinally extending runner portions to define a plurality of drainage apertures having longitudinally extending lateral edges, said slats and runner portions including means defining fluid passages for conveying a cooling fluid through said sleeve portion, said runner portions each defining a side edge of said sleeve portion, the improvement comprising:

slots in said runner portions, said slots being located between said lateral edges of said drainage apertures and respective side edges of said runner portions.

* * * * *

UNITED STATES PATENT AND TRADEMARK OFFICE

CERTIFICATE OF CORRECTION

PATENT NO. : 5,351,612
DATED : Oct. 4, 1994
INVENTOR(S) : Timothy G. Kemper, James King, Jr., and Hugo J. Espinal It is certified that error appears in the above-indentified patent and that said Letters Patent is hereby corrected as shown below:

Column 5, line 17, after "sleeve", insert --is--.

Signed and Sealed this

Thirteenth Day of December, 1994

*Attest:*

*Attesting Officer*

BRUCE LEHMAN

*Commissioner of Patents and Trademarks*